United States Patent [19]

Shevchenko

[11] 4,184,435

[45] Jan. 22, 1980

[54] INDUSTRIAL PALLETS AND METHOD OF MANUFACTURING

[76] Inventor: Richard Shevchenko, Medical Bldg., North Deerfield Pike, Bridgeton, N.J. 08302

[21] Appl. No.: 931,923

[22] Filed: Aug. 7, 1978

[51] Int. Cl.[2] ..... B65D 19/26

[52] U.S. Cl. ..... 108/57.1; 108/51.1

[58] Field of Search ..... 108/57.1, 51.1, 53.1-55.1, 108/56.1, 56.3; 256/19, 24; 217/43 A; 206/386, 595-600; 52/342, 818, 650, DIG. 9; 214/10.5 R

[56] References Cited

U.S. PATENT DOCUMENTS

| | | | |
|---|---|---|---|
| 622,666 | 4/1899 | Burwell | 108/54.1 |
| 2,377,911 | 6/1945 | Warren | 108/54.1 |
| 2,436,554 | 2/1948 | Cruickshank | 108/57.1 |
| 2,471,693 | 5/1949 | Lilienfeld . | |
| 2,683,010 | 7/1954 | Hamerslag, Jr. . | |
| 3,593,407 | 7/1971 | Brown . | |
| 3,977,333 | 8/1976 | Phillips | 108/54.1 |

FOREIGN PATENT DOCUMENTS

| | | | |
|---|---|---|---|
| 1049764 | 12/1953 | France | 108/51.1 |
| 468807 | 4/1969 | Switzerland | 108/51.1 |
| 1284362 | 8/1972 | United Kingdom | 206/596 |

OTHER PUBLICATIONS

"*Pallets and Palletization,*" National Wooden Pallet & Container Association, 1968.

*Primary Examiner*—William E. Lyddane
*Attorney, Agent, or Firm*—Stanley B. Kita

[57] ABSTRACT

Several embodiments of pallets which can be fabricated from scrap pieces of deckboard lumber are disclosed. Each pallet comprises top and bottom decks separated by a pair of outboard stringers disposed on opposite sides of intermediate stringer means. The decks may be of like or different construction, but at least one deck comprises a pair of long deckboards which extend the full distance across stringers adjacent their ends and short deckboards extending inwardly from the outboard stringers so that their free end portions are cantilevered in opposite directions with respect to the intermediate stringer means. The short deckboards are fastened to the intermediate stringer means and to one or the other of the outboard stringers.

A method of manufacturing pallets is disclosed.

18 Claims, 10 Drawing Figures

INDUSTRIAL PALLETS AND METHOD OF MANUFACTURING

FIELD OF THE INVENTION

The present invention relates to pallets, and more particularly, the present invention relates to wooden industrial pallets.

BACKGROUND OF THE INVENTION

Various types of wooden industrial pallets are known. Many are disclosed in *A Handbook of Wooden Pallet Construction and Usage* published by The National Wooden Pallet & Container Association. Customarily, industrial pallets comprise a pair, or three or more elongated stringers and a series of deckboards extending in spaced relation crosswise of the stringers.

In the conventional pallet, however, the deckboards are cut to uniform length corresponding to the desired width of the finished pallet. Thus, depending upon the lengths of the boards from which the deckboards are cut, short lengths of boards are left over. Prior to the present invention, these short boards have simply been bundled and sold for firewood or burned by the manufacturer. Needless to say, this is an economically undesirable end use for good quality boards. Thus, a pallet construction which enables the short scrap boards to be used for decking is economically and environmentally desirable.

Several types of patented pallets are known. For instance, U.S. Pat. Nos. 622,666; 2,377,911; and 3,977,333 disclose adjustable pallets which are designed to be expanded or contracted depending upon the desired deck area. U.S. Pat. No. 3,593,407, on the other hand, discloses a pallet having a deckboard cut from plywood in such a manner as to provide a complementary pair of decks without wasting any of the plywood. U.S. Pat. Nos. 2,471,693 and 2,683,010 disclose other types of wooden pallets.

OBJECTS OF THE INVENTION

With the foregoing in mind, a primary object of the present invention is to provide a novel pallet construction which helps to conserve the nation's forest resources by enabling waste lumber to be used satisfactorily.

It is another object of the present invention to provide a unique pallet which is economical to manufacture.

As a further object, the present invention provides an improved pallet construction which enables waste lumber to be utilized as deckboards while providing a strong and durable pallet.

A still further object of the present invention is to provide a pallet construction having deckboards which interlock laterally in interdigitated cantilevered relation in the central zone of the pallet to provide a pallet having substantial resistance to racking.

SUMMARY OF THE INVENTION

More specifically, the present invention provides a pallet which comprises top and bottom decks separated by a pair of stringers located outboard of intermediate stringer means to provide between the decks a pair of entryways for a forklift. At least one of the decks comprises a plurality of deckboards of long and short lengths extending across the stringers. A pair of long deckboards extend the full distance across the deck and are fastened to the stringers adjacent their ends. The short deckboards extend less than the full distance across the deck but greater than a distance between the outboard stringers and the medial stringer means. The short deckboards are arranged in the deck so that they extend inwardly from the outboard stringers with their free end portions cantilevered in opposite directions with respect to the intermediate stringer means.

Preferably, the pallet is manufactured by assembling the outboard stringers in spaced parallel relation with the outboard stringers spaced apart a predetermined dimension and the medial stringer disposed between the outboard stringers. Long deckboards having a length corresponding to the spacing of the outboard stringers are selected, and they are fastened to all of the stringers. Short deckboards having a length greater than the dimension between the medial stringer and either outboard stringers are selected, and they are arranged on the stringers so that they extend inwardly from the outboard stringers with their end portions cantilevered across the intermediate stringer means. The long deckboards are fastened to all the stringers, but the short deckboards are fastened only to the intermediate stringer means and to one or the other outboard stringers.

The short deckboards may be selected to be of random length in which case it is preferable for the deckboards to be laterally engaged with one another in the zone of the intermediate stringer means before they are fastened to the stringers and trimmed with respect to the outboard stringers.

BRIEF DESCRIPTION OF THE DRAWINGS

The foregoing and other objects, features and advantages of the present invention should become apparent from the following description when taken in conjunction with the accompanying drawings in which.

DESCRIPTION OF PREFERRED EMBODIMENTS

Figure 1:
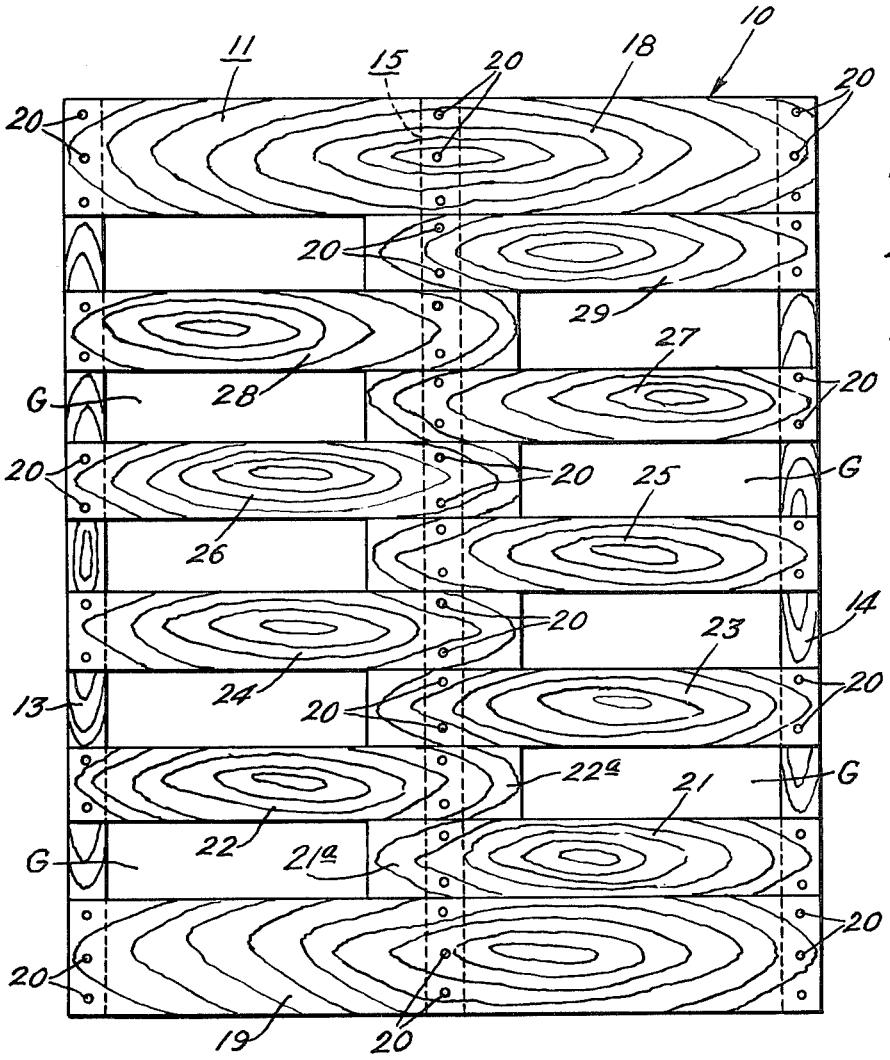
FIG. 1 is a plan view of a pallet embodying the present invention.
Figure 2:
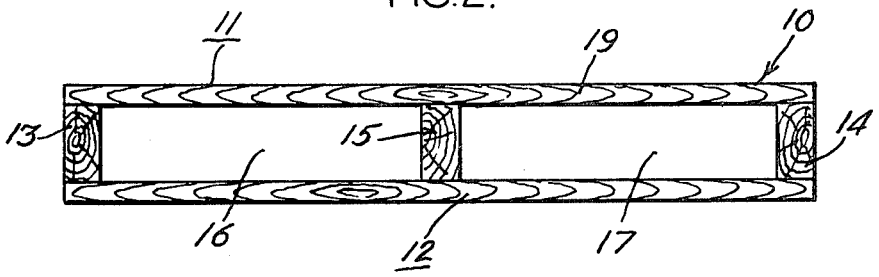
FIG. 2 is an end view thereof.

Referring now to the drawings, FIG. 1 illustrates a pallet 10 which embodies the present invention. As best seen in FIG. 2, the pallet 10 has a top deck 11 and a bottom deck 12 which are separated vertically from one another by means of stringers or stringer members. In this embodiment, three stringers are employed: a pair of outboard stringers 13 and 14 disposed on opposite sides of an intermediate or medial stringer 15. The stringers cooperate with the decks 11 and 12 to provide a pair of spaces or entryways 16 and 17 for the forks of a lift truck. For the purpose of illustration, the pallet of FIG. 1 is of conventional size and has a widthwise dimension of 40" and a lengthwise dimension of 48".

Figure 3:
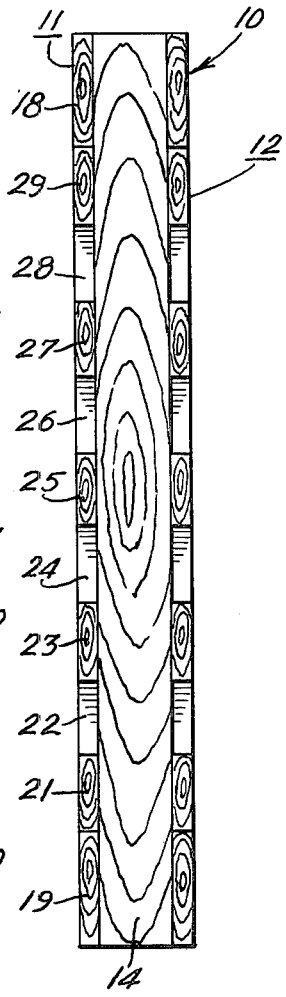
FIG. 3 is a side elevational view thereof.

In the embodiment illustrated in FIGS. 1–3, the top and bottom decks 11 and 12 are of like construction because this enables the maximum advantages of the present invention to be realized. It should be understood, however, that the decks may be of different construction depending upon the particular requirements of the end user. Hereinafter, reference will be made to the top deck 11, it being understood that in this embodiment the bottom deck 12 is exactly the same.

The deck 11 comprises a series of deckboards disposed across the stringers 13, 14 and 15. As will become apparent, the deckboards are of long and short lengths relative to the dimensions between the stringers 13, 14 and 15. For instance, the long end deckboards 18 and 19 extend across all of the stringers 13, 14 and 15 and are fastened thereto adjacent opposite ends of the stringers 13, 14 and 15 by means of fasteners 20 such as nails, screws, etc. The short deckboards, on the other hand, are the deckboards 21–29 which are disposed in the plane of the deck 11 between the long end deckboards 18 and 19. The short deckboards, such as the deckboards 21 and 22, have a length which is less than the dimension between the stringers 13 and 14 but which is greater than the dimension between either stringer 13 or 14 and the intermediate stringer 15. Thus, the short deckboards 21 and 22 have end portions 21*a* and 22*a*, respectively, which extend across the medial stringer 15 in cantilever fashion to interdigitate with one another centrally of the deck 11 in the zone of the medial stringer 15 in the manner illustrated in FIG. 1. The short deckboards 21 and 22 are fastened to medial stringer 15 and to the outboard stringers 14 and 13, respectively. The other short deckboards 23–29 are similarly dimensioned and fastened. Preferably, the short deckboards 21–29 abut one another edgewise along the medial stringer 15, and the outermost short deckboards 21 and 29 abut the long end deckboards 19 and 18, respectively, along their entire lengths. Thus, there exists between the short deckboards, gaps G which correspond to the width of the deckboard.

The lateral interdigitating engagement of the short deckboards 21–29 along the medial stringer 15 improves the resistance of the pallet 10 to "racking" which is defined as the resistance of the outboard stringers to movement relative to one another in response to a force couple applied axially thereto. Also, the lateral engagement of the deckboards along the medial stringer 15 helps to prolong the life of pallet 10 by providing backup for the end deckboards 18 and 19 so that they resist loosening when struck edgewise by forklift trucks. The cantilevered interdigitation of the short deckboards centrally of the deck increases the versatility of the pallet by enabling it to support bags or barrels stacked in various arrangements. Of course, of greatest significance is the fact that scrap deckboard lumber which heretofore would have been discarded can now be utilized for the short deckboards 21–29. This results in a conservation of forest resources because it enables the pallet manufacturer to utilize lumber which otherwise would have been used for firewood, a low economic use for good quality lumber.

Other than the sizes and arrangement of the short and long deckboards, the pallet 10 is fabricated according to conventional practice. For instance, the stringer members 13, 14 and 15 are preferably cut from 2"×4" lumber, the endboards 18 and 19 are preferably cut from 1"×6" lumber, and the short deckboards 21–29 are preferably cut from 1"×4" lumber. The type of wood from which the lumber is cut depends upon the particular specifications of the pallet. The wood may be selected from hardwoods such as oak, softwoods such as hemlock, or woods of intermediate hardness.

Figure 4:
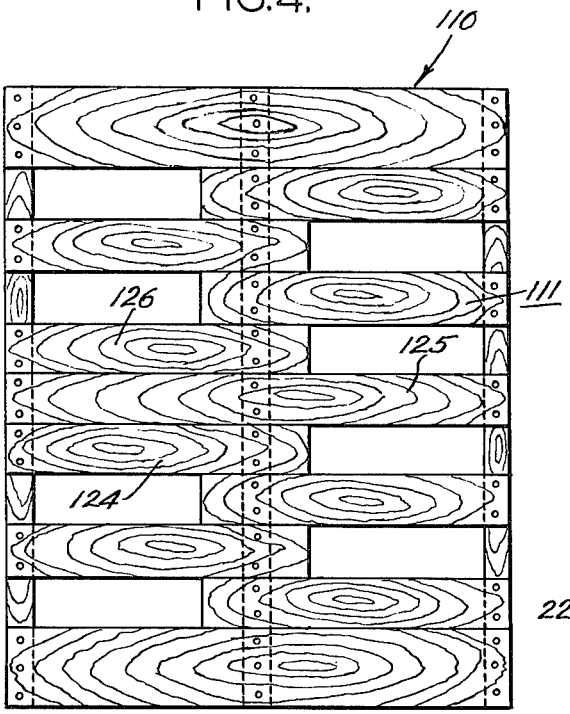
FIG. 4 is a plan view of a modified embodiment wherein a long central deckboard is provided.

Referring now to FIG. 4, a modified embodiment 110 of the present invention is illustrated having a deck 111 like the deck 11 in the embodiment of FIGS. 1–3. In this embodiment, however, a long deckboard 125 is provided at about the longitudinal median of the deck in place of the short deckboard 25 illustrated in FIG. 1. This has the advantage of providing greater resistance of the pallet 110 to racking because of the interdigitating abutting relation of the center deckboard 125 with its adjacent short deckboards 124 and 126.

Figure 5:
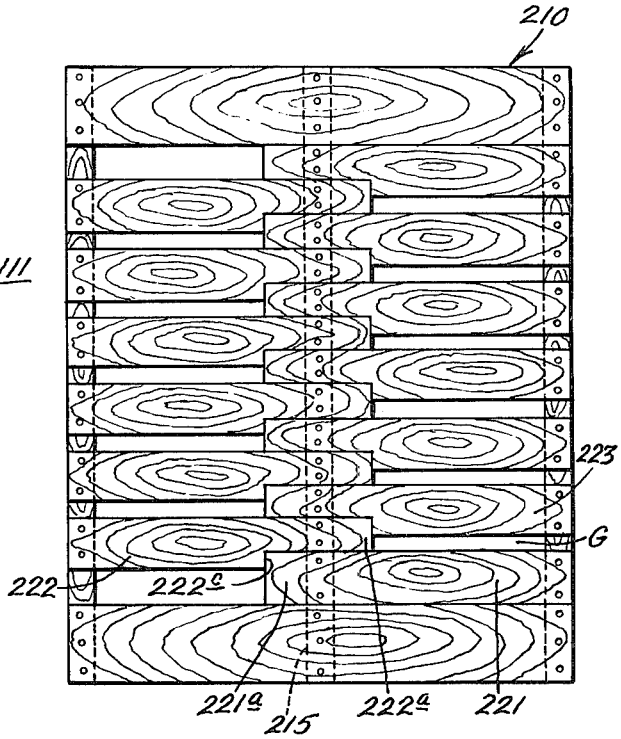
FIG. 5 is a plan view of another modified embodiment wherein a narrow spacing is provided between deckboards.

Another of the modified embodiments of the present invention is illustrated in FIG. 5. This embodiment 210 is designed to provide reduced spacing between the deckboards and is particularly suited for use in those applications where bags of materials are stacked. To this end, the short deckboards, such as the deckboard 222 is provided with an L-shaped notched edge 222*c* extending inwardly from its free end portion 222*a*. The notch 222*c* is dimensioned in opposite directions from the medial stringer 215 so as to provide edges of about equal length on opposite sides of the medial stringer 215. Thus the free end portion 221*a* dovetails and interengages with the notched portion 222*c* of the deckboard 222 in the manner illustrated in FIG. 5. As a result, the gap G between the deckboard 221 and its adjacent deckboard 223 is relatively narrow as compared with the gaps G between the deckboards 21 and 23 in the embodiment illustrated in FIG. 1. The deckboard 221 may be notched like the other deckboards 222 and 223, or it may be full sized as illustrated. It should be noted that in this embodiment thirteen short deckboards are utilized as contrasted with the embodiment of FIG. 1 and FIG. 4 wherein nine deckboards are required. The notched and interdigitated arrangement of short deckboards cooperates to enhance the racking resistance of the pallet 210.

Figure 6:
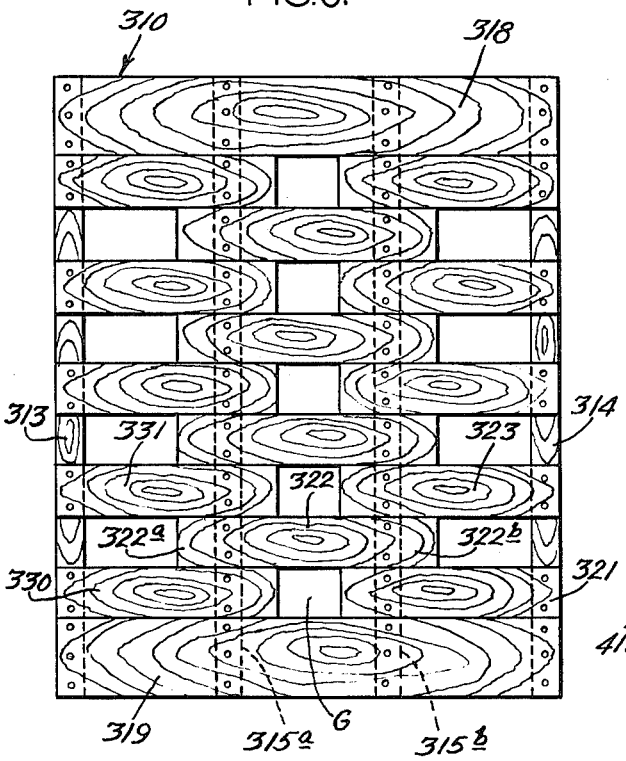
FIG. 6 is a plan view of another modified embodiment having a pair of inboard stringers.

In a still further modified embodiment of the present invention, pallets can be produced using even shorter lengths of short deckboards than those illustrated in the embodiments described hereinbefore. For instance, as best seen in FIG. 6, a pallet 310 is illustrated and comprises a pair of outboard stringers 313 and 314 disposed on opposite sides of inboard stringer means which, in the illustrated embodiment, includes a pair of inboard stringers 315*a* and 315*b*. Long deckboards 318 and 319 are fastened across the ends of the stringers 313, 314, 315*a* and 315*b* in the customary manner. In this embodiment, however, the short deckboards 321 and 330 are aligned endwise across the stringers 314 and 315*b*, and 313 and 315*a*, respectively with a gap G provided between their confronting ends. Another short length of deckboard 322 is abutted edgewise against the edges of the deckboards 321 and 330 and has its end portions 322*a* and 322*b* extending outwardly beyond the medial stringers 315*a* and 315*b* in cantilever fashion and in interdigitated relation with other short deckboards 321, 330, 323, and 331.

The pallet 310 of this embodiment has the additional advantage of enabling even shorter lengths of deckboards to be utilized in the decking while providing long life, racking resistance and a substantial load supporting surface.

Figure 7:
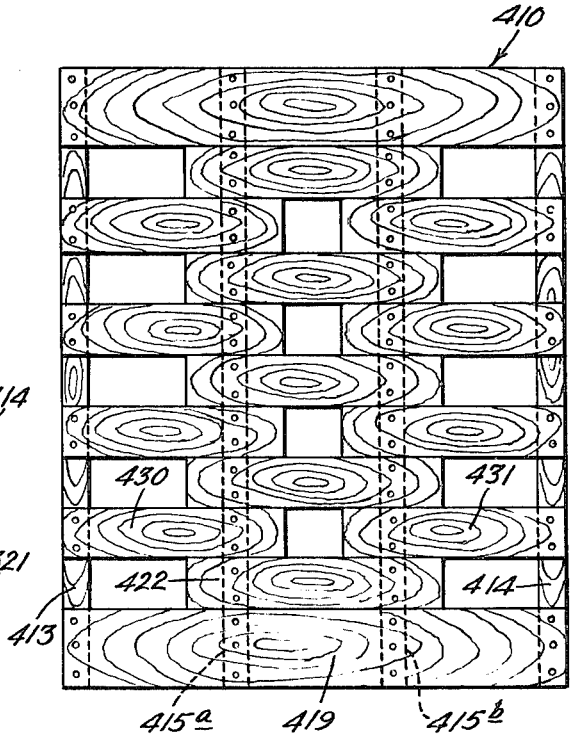
FIG. 7 is a plan view of another modified embodiment somewhat similar to FIG. 6 but having a different deckboard arrangement.

The embodiment of the pallet 410 illustrated in FIG. 7 is generally similar to the embodiment illustrated in FIG. 6 except that the lower central deckboard 422 extends across the inboard stringer members 415*a* and 415*b* and is abutted edgewise against the lowermost end deckboard 419 which extends across the outboard stringers 413 and 414. The other short deckboards 430 and 431 abut edgewise against the upper edge of the deckboard 422 in the manner illustrated.

Figure 8:
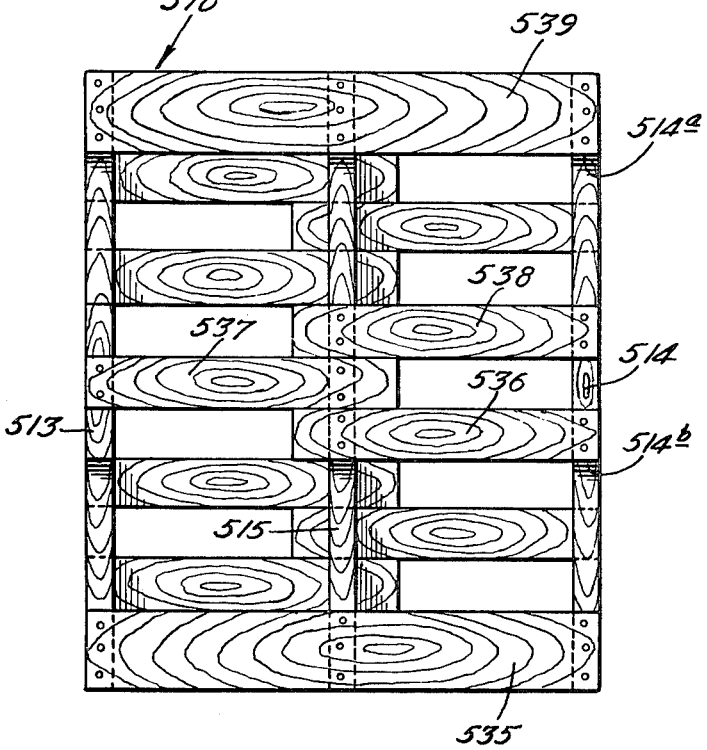
FIG. 8 is an inverted plan view of a four-way pallet having one deck constructed according to the present invention.
Figure 9:
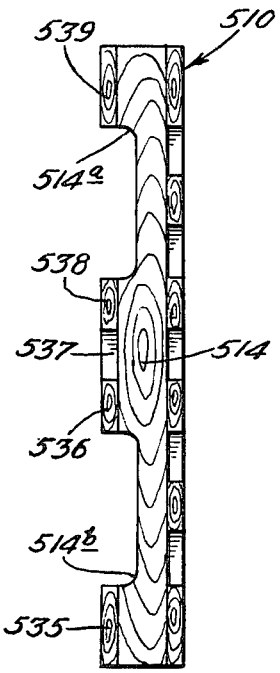
FIG. 9 is a side elevational view thereof.

Referring now to FIGS. 8 and 9, the embodiment of the pallet 510 illustrated therein is similar to the embodiment illustrated in FIGS. 1–3 because the top decks in each embodiment are of the same construction. They are different to the extent that in the embodiment of FIGS. 1–3 both decks are of like construction; whereas in the embodiment of FIGS. 8 and 9, the top and bottom decks are of different construction and the pallet 510 is of so-called four-way design because the bottom edges of each of the stringers 513, 514 and 515 are provided with axially-spaced notches such as 514*a* and 514*b* in stringer 514 which enable the pallet 510 to be picked up by a forklift disposed at right angles to the stringers. The deckboards 535 and 539 extend the full distance across all of the stringers and are fastened thereto in the customary manner; however, the deckboards 536, 537 and 538 are arranged similar to the deckboards 24,25 and 26 in the embodiment of FIG. 1. Thus, in this embodiment, the advantages which inhere in the use of short deckboards are realized in a four-way pallet construction.

Figure 10:
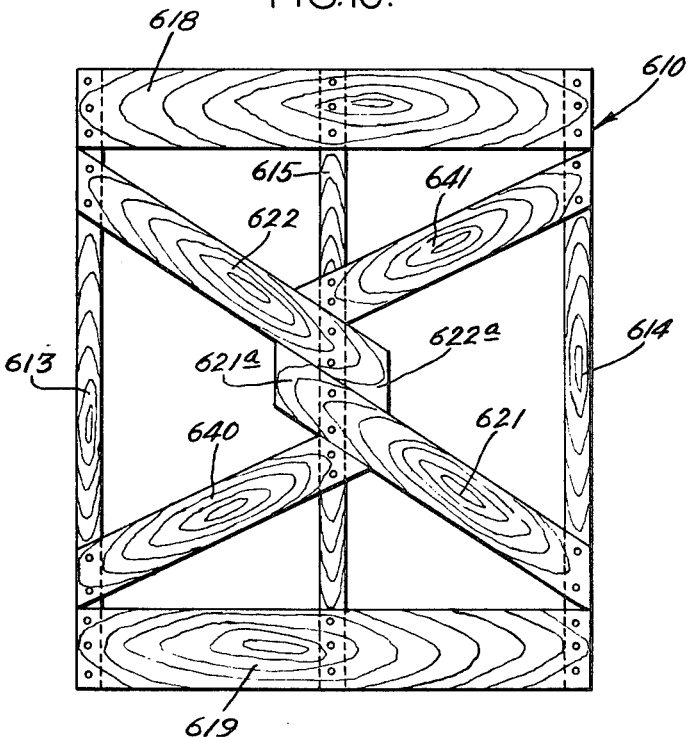
FIG. 10 is a plan view of a light-duty pallet embodying the present invention.

In FIG. 10 there is illustrated yet a further modified embodiment of the present invention. In this embodiment the pallet 610 is designed to be used with so-called slip-sheets or bulky, lightweight materials. As in the previous embodiments, a medial stringer member 615 is disposed about halfway between the outboard stringers 613 and 614. A pair of long end deckboards 618 and 619 are fastened in the customary manner across the ends of the stringers 613–615. A pair of shorter length deckboards 621 and 622 extend inwardly from the outboard stringers 614 and 613, respectively, in a generally diagonal fashion to engage one another edgewise in the zone of the medial stringer 615 with their end portions 621*a* and 622*a* cantilevered in opposite directions with respect to the medial stringer 615. Another pair of relatively short deckboards 640 and 641 extend inwardly from the outboard stringers 613 and 614, respectively, to engage the edges of the deckboards 621 and 622 in the zone of the medial stringer 615 in the manner illustrated in FIG. 10 at an oblique angle with respect to the diagonal deckboards 621 and 622. If desired, the free ends 621*a* and 622*a* of the deckboards 621 and 622 may have a greater or lesser amount of cantilever, depending upon the amount of area coverage desired in the deck surface.

It should also be noted that if a pallet having an open deck surface is desired, the short deckboards 21, 22, 23 and 27, 28 and 29 in the pallet 10 illustrated in FIG. 1 may simply be eliminated to provide a pallet having about the same utility as the pallet 610 illustrated in FIG. 10.

As described thus far, the short deckboards are all of uniform length. Although this may be aesthetically desirable, it should be understood that the lengths of the short deckboards may be random so that the extent of the cantilevered free end portions may be more or less than illustrated. In the illustrated embodiments, a cantilever of about 3" has been shown because such a dimension has been found satisfactory in providing adequate lateral interdigitation between the short deckboards and a deck area adequate for most loads.

In the previously described embodiments, the deckboards are cut to length before being assembled on the stringers and fastened thereto. In manufacturing the pallets, the outboard pair of stringers are disposed a predetermined dimension apart outboard and parallel to at least one intermediate stringer. A pair of long deckboards having a length corresponding to the dimension of the outboard stringers is selected, and a plurality of other short deckboards having lengths shorter than that predetermined dimension but greater than the dimension between either outboard stringer and the intermediate stringer are selected. The long deckboards are fastened to the ends of the stringers and the other short deckboards are fastened to the outboard stringers and the intermediate stringer in such a manner that they extend inwardly in opposite directions in cantilever fashion across the intermediate stringer. Preferably, this procedure is started adjacent one end deckboard and proceeds along the length of the stringers to the other end deckboard. Preferably, the short deckboards are abutted edgewise sequentially along the medial stringer before they are fastened.

Rather than trimming all of the short deckboards to a predetermined length before fastening to the stringers, they may be fastened to the medial stringer in proper interdigitated cantilever relation with their outer free ends overhanging the outboard stringers, whereupon the overhanging extensions can simply be trimmed. If desired, the deckboards may be fastened in proper relation on a glue or tape strip and may be trimmed either before or after assembly onto the stringers. Also, if this manufacturing technique is used, the deckboards may have a tongue and groove interengagement along their edges to rigidify the assembly and to facilitate handling prior to assembly and trimming.

In view of the foregoing, it should be apparent that the present invention now provides novel relatively low-cost pallets which enable waste lumber to be utilized. In addition to being economical to manufacture, the pallets are strong, resistant to racking, and have relatively long service lives. Because scrap lumber can be used, the pallets of the present invention contribute to the conservation of the nation's forest resources.

While preferred embodiments of pallets and methods of manufacturing them have been described in detail, various modifications, alterations and changes may be made without departing from the spirit and scope of the present invention and defined in the appended claims.

I claim:

1. In a pallet assembly, including a top deck, a bottom deck, outboard stringer means interposed between said decks to provide a space between said decks, and intermediate stringer means disposed between said outboard stringer means to divide the space between the decks into entryways for a forklift, the improvement wherein at least one of said decks comprises a plurality of deckboards of relative long and short lengths, a pair of said long deckboards extending the full distance across said stringer means at opposite ends thereof, said short deckboards being disposed between said long deckboards and extending less than the full distance across said outboard stringer means but greater than the distance between the outboard stringer means and said intermediate stringer means, said short deckboards being arranged on said stringer means so that they extend inwardly from opposite outboard stringer means and have free end portions cantilevered in opposite directions across said intermediate stringer means and interdigitate with one another in the zone of said intermediate stringer means, and means fastening said deckboards to said stringer means to form a unitary pellet structure.

2. A pallet assembly according to claim 1 wherein said outboard stringer means includes a pair of stringer members, and said intermediate stringer means includes a medial stringer member disposed between and parallel to said outboard stringer members about halfway therebetween.

3. A pallet assembly according to claim 2 wherein said deckboards engage one another laterally along the medial stringer member.

4. A pallet assembly according to claim 1 wherein said short deckboards are notched in the zone of said intermediate stringer means and alternate ones laterally engage one another to provide between adjacent deckboards a gap of less width than the width of the short deckboards.

5. A pallet assembly according to claim 1 wherein each of said outboard stringer means has a pair of spaced notches in one edge and said deck extends across the stringer means on the edge opposite said one edge.

6. A pallet assembly according to claim 1 wherein one pair of said short deckboards extend inwardly diagonally from said outboard stringer means to engage laterally one another across the intermediate stringer means, and another pair of short deckboards extend inwardly across said intermediate stringer means to form an oblique angle with respect to said one deckboard pair.

7. A pallet assembly according to claim 1 wherein said long deckboards are wide relative to said short deckboards.

8. A pallet assembly according to claim 1 including at least another long deckboard extending across said intermediate stringer about midway between said pair of long deckboards.

9. A pallet assembly according to claim 1 wherein both decks are of like construction.

10. In a pallet assembly, including a top deck, a bottom deck, outboard stringer means interposed between said decks o provide a space between said decks, and intermediate stringer means disposed between said outboard stringer means to divide the space between the decks into entryways for a forklift, the improvement wherein at least one of said decks comprises a plurality of deckboards of relative long and short lengths, a pair of said long deckboards extending the full distance across said stringer means at opposite ends thereof, said short deckboards being disposed between said long deckboards and extending less than the full distance across said outboard stringer means but greater than the distance between the outboard stringer means and said intermediate stringer means, said short deckboards being arranged on said stringer means so that they extend inwardly from opposite outboard stringer means and have free end portions cantilevered in opposite directions across said intermediate stringer means, and means fastening said deckboards to said stringer means to form a unitary pallet structure, said intermediate stringer means including a pair of inboard stringer members disposed in spaced parallel relation between said pair of outboard stringer means, certain ones of said short deckboards extending inwardly from the outboard stringer means in endwise alignment in cantilever fashion across said inboard stringer members, and certain other ones of said short deckboards extending across only said inboard stringer members in cantilever fashion to terminate with the free ends spaced from both of said outboard stringer means.

11. A pallet assembly according to claim 10 wherein said certain ones and other ones of said deckboards alternate in said deck.

12. A pallet assembly according to claim 11 wherein said short deckboards interdigitate with and laterally engage one another in the zone of said inboard stringer members in said deck.

13. A pallet assembly according to claim 12 wherein said certain ones of said deckboards laterally engage said long deckboards.

14. A pallet assembly according to claim 12 wherein said certain other ones of said deckboards laterally engage said long deckboards.

15. A pallet assembly according to claim 10 wherein said deckboards engage one another laterally along said intermediate stringer means.

16. A method of manufacturing a pallet comprising the steps of:

disposing a pair of stringers a predetermined dimension apart outboard of and parallel to at least one intermediate stringer, selecting a pair of deckboards having a length corresponding to at least said predetermined dimension, selecting a plurality of other deckboards having lengths shorter than said predetermined dimension but greater than the dimension between either of said outboard stringers and said intermediate stringer, disposing said pair of deckboards across each stringer adjacent its ends, disposing said other deckboards relative to said outboard stringers and said intermediate stringer so that they extend inwardly in opposite directions in cantilever fashion across said intermediate stringer to interdigitate with one another in the zone of said intermediate stringer, and fastening said deckboards to said stringers.

17. A method according to claim 16 including the steps of abutting the deckboards edgewise before fastening along said intermediate stringer to provide gaps between the deckboards.

18. A method according to claim 17 wherein the other selected deckboards have random lengths and including the step of trimming the outboard ends of the deckboards after having been abutted edgewise.

* * * * *